US008715038B2

(12) United States Patent
Cheon

(10) Patent No.: US 8,715,038 B2
(45) Date of Patent: May 6, 2014

(54) APPARATUS FOR DEBURRING WORKPIECE

(75) Inventor: Kyeong Ho Cheon, Sacehon-si (KR)

(73) Assignee: Korea Aerospace Industries, Ltd., Sacheon-si, Gyeongsangnam-do (KR)

( * ) Notice: Subject to any disclaimer, the term of this patent is extended or adjusted under 35 U.S.C. 154(b) by 199 days.

(21) Appl. No.: 13/328,566

(22) Filed: Dec. 16, 2011

(65) Prior Publication Data

US 2013/0102233 A1 Apr. 25, 2013

(30) Foreign Application Priority Data

Oct. 24, 2011 (KR) ..... 10-2011-0108779

(51) Int. Cl.
*B24B 7/00* (2006.01)
*B24B 47/02* (2006.01)
*B24B 55/04* (2006.01)

(52) U.S. Cl.
USPC ..... 451/66; 451/109; 451/184; 451/336; 451/451; 451/454

(58) Field of Classification Search
USPC ..... 451/10, 11, 65, 66, 109, 110, 178, 182, 451/184, 336, 451, 454
See application file for complete search history.

(56) References Cited

U.S. PATENT DOCUMENTS 4,649,670 A * 3/1987 Snyder ..... 451/42
4,711,053 A * 12/1987 Snyder ..... 451/65
RE34,014 E * 8/1992 Hundebol ..... 451/211
5,274,962 A * 1/1994 Hundebol ..... 451/28
5,291,689 A * 3/1994 Hundebol ..... 451/124
5,441,440 A * 8/1995 Hundebol ..... 451/28
5,558,561 A * 9/1996 Hundebol ..... 451/28
5,601,481 A * 2/1997 Hundeb.o slashed.l ..... 451/178
5,733,180 A * 3/1998 Kilde ..... 451/65
6,080,039 A * 6/2000 Bartlett et al. ..... 451/9
6,227,940 B1 * 5/2001 Bartlett et al. ..... 451/10
6,234,887 B1 * 5/2001 Hundeb.o slashed.l ..... 451/358
6,244,933 B1 * 6/2001 Morkvenas ..... 451/10
6,500,058 B2 * 12/2002 Bajo et al. ..... 451/361
6,629,880 B1 * 10/2003 Kang et al. ..... 451/59
2002/0037692 A1 * 3/2002 Bajo et al. ..... 451/361

FOREIGN PATENT DOCUMENTS

EP 458726 A1 * 11/1991 ..... B24B 21/04
KR 100855636 B1 8/2008
KR 10-2009-0132935 A 12/2009
KR 1020100090176 A 8/2010

* cited by examiner

*Primary Examiner* — Eileen P. Morgan
(74) *Attorney, Agent, or Firm* — Novick, Kim & Lee, PLLC; Jae Youn Kim

(57) ABSTRACT

Disclosed is a deburring apparatus. The deburring apparatus includes a transfer module installed on a base to form a transfer path of transferring a workpiece to be deburred, a deburring module provided on the transfer path of the workpiece installed on the base to deburr the workpiece, and a blocking cover installed on the base to reciprocate thereon to selectively prevent the transfer module and the workpiece on the transfer module from being exposed to an outside, and to prevent dust and noise, which are produced when a deburring work is performed for the workpiece by using the deburring module, from being delivered to the outside. The burrs, which are produced when a metallic produce or a non-metallic produce having a 3-D shape is molded or cut, are easily and rapidly removed.

8 Claims, 5 Drawing Sheets

APPARATUS FOR DEBURRING WORKPIECE

BACKGROUND OF THE INVENTION

1. Field of the Invention

The present invention relates to a deburring apparatus. In more particular, the present invention relates to a deburring apparatus capable of reducing the contamination of a working place caused by noise and foreign matters produced in a deburring work while automatically removing burrs produced when a metallic product or a non-metallic product is molded or cut.

2. Description of the Related Art in general, in order to remove burrs of a workpiece, as disclosed in Korean Patent Unexamined Publication No. 10-2009-0132935, a worker has manually performed a deburring work by using a drilling tool or a hand tool such as sand paper. In addition, in a case that an automation arrangement has a very complex internal shape, the mechanical design of the automation arrangement to remove burrs is very difficult. Accordingly, the burrs have been manually removed.

However, a scheme to manually remove the burrs may increase the time and cost to manufacture a finished product.

In addition, since the automation arrangement to remove burrs is not provided, most manufacturing cost is caused by the manual work of removing the burrs, and the quality of the manufactured product is not uniform.

Meanwhile, when an automation arrangement is used in order to remove the burrs, the position (coordinates) of the burrs randomly distributed must be designated. To this end, robotics must be employed for automation. However, this cannot actually make many difficulties.

CITED REFERENCE

Patent Reference 1: Korean Patent Unexamined Publication No. 10-2009-0132935 (published on 31 Dec., 2009).

SUMMARY OF THE INVENTION

Accordingly, the present invention has been made keeping in mind the above problems occurring in the prior art, and an object of the present invention is to provide a deburring apparatus, capable of minimizing the contamination of a working place caused by noise and foreign matters produced in a deburring work while automatically removing burrs produced when a metallic product or a non-metallic product is molded or cut.

The above and other objects of the present invention will be more clearly comprehended by those skilled in the art from the following detailed description.

To accomplish the above objects, according to one aspect of the present invention, there is provided a deburring apparatus including a transfer module installed on a base to form a transfer path of transferring a workpiece to be deburred, a deburring module provided on the transfer path of the workpiece installed on the base to deburr the workpiece, and a blocking cover installed on the base to reciprocate thereon to selectively prevent the transfer module and the workpiece on the transfer module from being exposed to an outside, and to prevent dust and noise, which are produced when a deburring work is performed for the workpiece by using the deburring module, from being delivered to the outside.

In this case, the blocking cover may cover front and rear regions of the deburring module, and have a corrugation structure or a structure in which a plurality of cover pieces are linked with each other in such a manner that the cover pieces are folded.

The deburring apparatus further may include a transfer unit installed in the base and the blocking cover to move the blocking cover, wherein the transfer unit includes one selected from the group consisting of a rack-gear unit, a linear gear unit, and a cylinder unit.

The blocking cover may include a transparent material or a semi-transparent material.

The deburring module may include a module wall defining an internal space, having an entrance to introduce the workpiece and an exit to discharge the workpiece, and serving as a first soundproof wall, a deburring unit installed in the internal space of the module wall, and including a rotational shaft, which is rotatable by a first driving unit, and a plurality of deburring wheels which are installed around the rotational shaft while being spaced apart from each other, and rotatable by a second driving unit, and second soundproof walls installed between the module wall and the deburring unit.

The second soundproof walls may be installed at left and right sides of the transfer module, respectively, and have arc-shape surfaces corresponding to a rotation radius of the deburring unit.

The module wall and the second soundproof walls may include acoustic absorbent.

The deburring module further may include a plurality of ducts installed on the module wall to discharge foreign matters produced in the deburring work for the workpiece to the outside after sucking the foreign matters.

As described above, the deburring apparatus according to the embodiment of the present invention has following effects.

First, the deburring apparatus according to the embodiment of the present invention can easily and rapidly remove burrs produced when a metallic produce or a non-metallic produce having a 3-D shape is molded or cut.

Second, the deburring apparatus according to the embodiment of the present invention can minimize noise, which is caused by the deburring work and the transfer of the workpiece to be deburred, by the blocking cover, which is installed on the base to reciprocate, and the first and second soundproof walls constructing a double structure.

Third, the deburring apparatus according to the embodiment of the present invention can rapidly discharge the foreign matters (dust and removed burrs) produced in the deburring work to the outside by installing the ducts on the module wall, so that the working space can be maintained in a cleaned state, and the continuity of the deburring work can be improved.

The effects and other effects according to the present invention can be apparently comprehended by those skilled in the art from the following description.

DETAILED DESCRIPTION OF THE INVENTION

Hereinafter, exemplary embodiments of the present invention will be described in more detail with respect to accompanying drawings. However, the present invention is not limited to following disclosed embodiments, but can be realized as various modifications. The present embodiments make the disclosure of the present invention perfect, and provided for illustrative purposes, so that those skilled in the art can perfectly comprehend the scope and the spirit of the present invention. The same reference numbers will be assigned to the same elements in the accompanying drawings.

Figure 1:
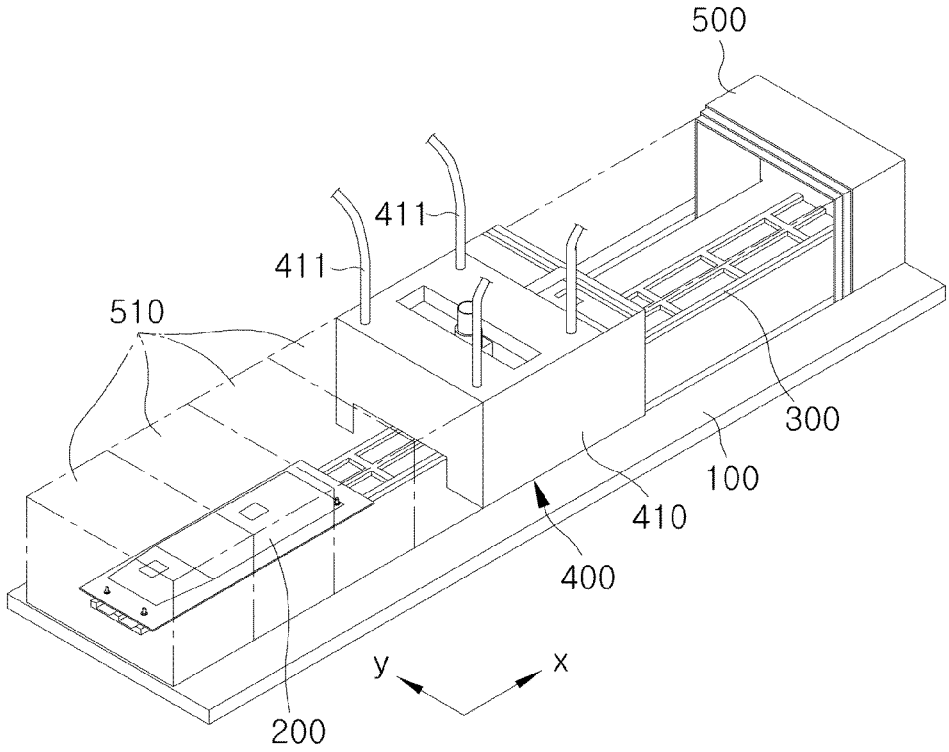
FIG. 1 is a perspective view showing a deburring apparatus according to one embodiment of the present invention.
Figure 2:
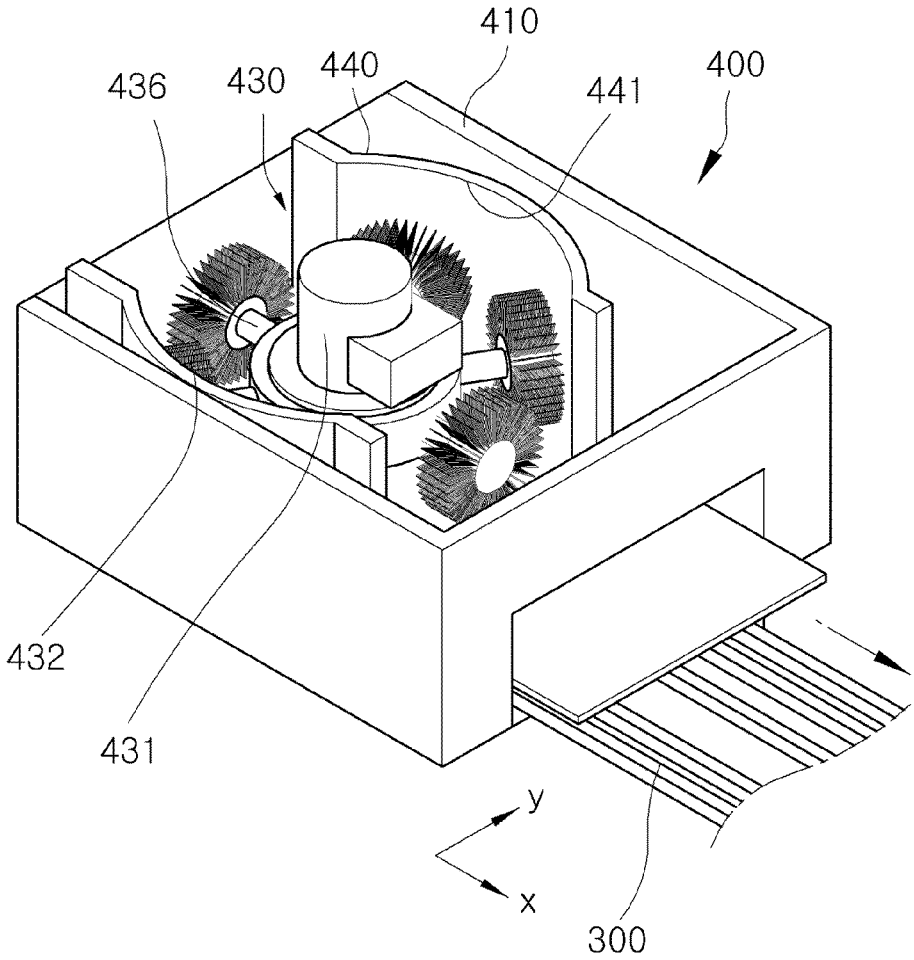
FIG. 2 is a perspective view showing a part of the internal structure of a deburring module in the deburring apparatus according to one embodiment of the present invention.
Figure 3:
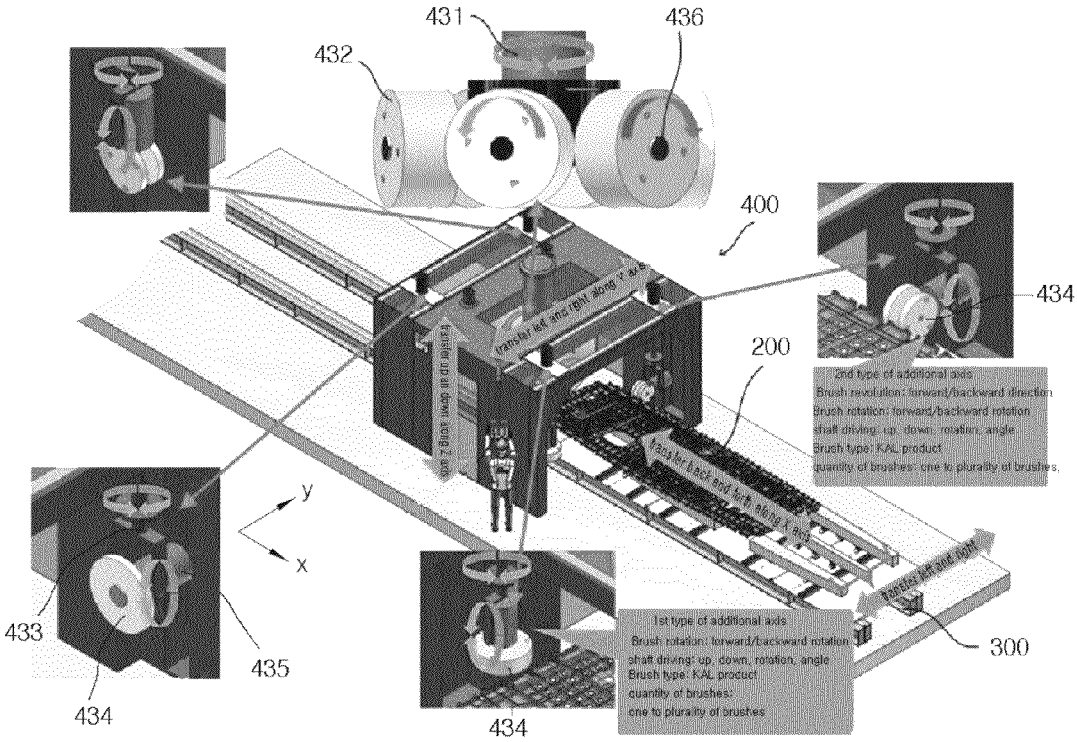
FIGS. 3 and 4 are views showing the deburring procedure using the deburring apparatus according to the embodiment of the present invention.
Figure 4:
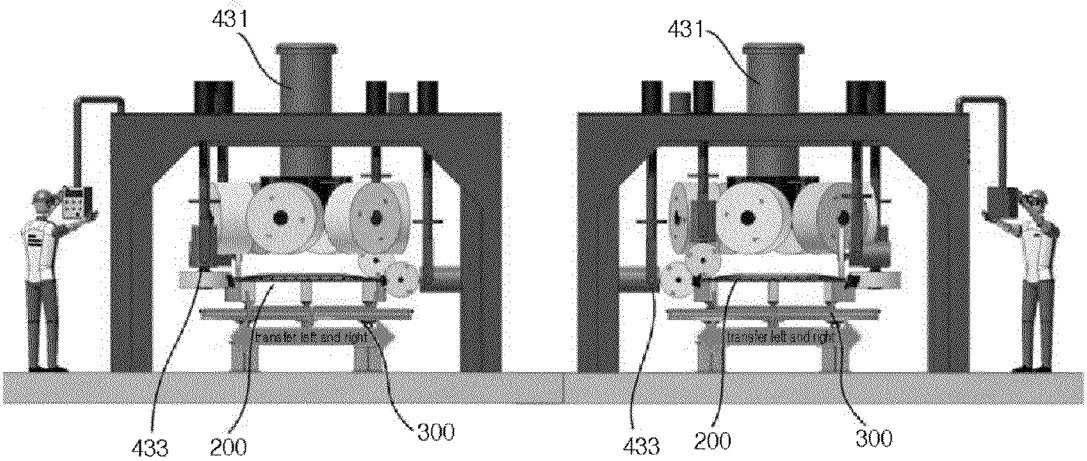
Figure 5:
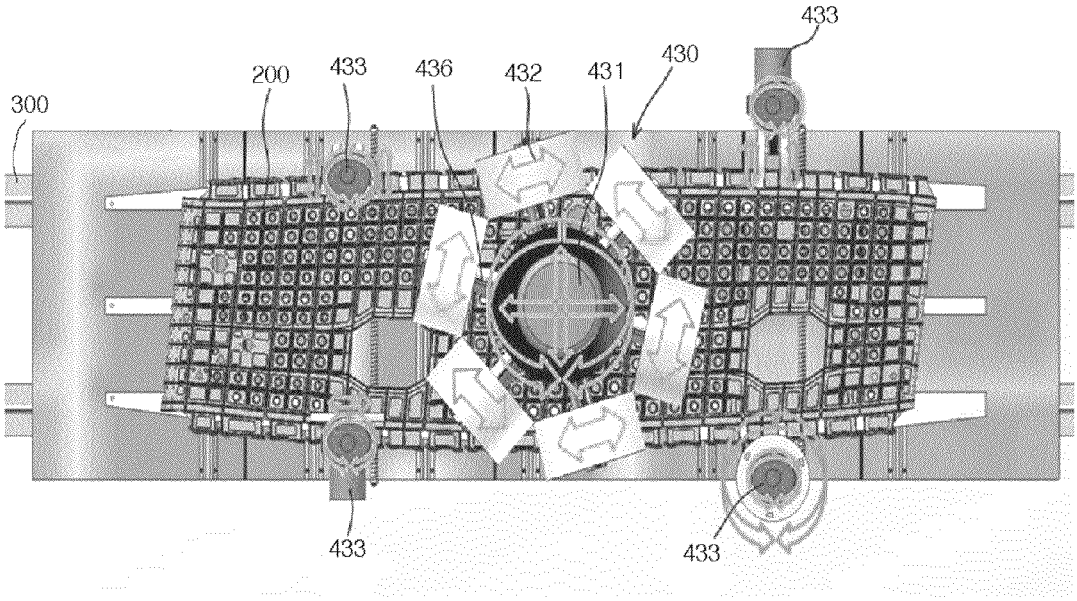
FIG. 5 is a plan view showing main components in the deburring apparatus according to the embodiment of the present invention.

FIG. 1 is a perspective view showing a deburring apparatus according to one embodiment of the present invention, FIG. 2 is a perspective view showing a part of the internal structure of a deburring module in the deburring apparatus according to one embodiment of the present invention, FIGS. 3 and 4 are views showing the deburring procedure using the deburring apparatus according to the embodiment of the present invention, and FIG. 5 is a plan view showing main components in the deburring apparatus according to the embodiment of the present invention.

As shown in accompanying drawings, the deburring apparatus according to an exemplary embodiment of the present invention can improve working environment in a deburring working place by minimizing the transfer or the discharge of the noise and foreign matters (including dust or removed burrs) produced in a deburring work. The deburring apparatus includes a transfer module 300 mounted on a base 100 and forming a transfer path to transfer a workpiece 200 to be deburred (hereinafter, workpiece), a deburring module 400 mounted on the transfer path of the workpiece 200 to deburr the workpiece 200, and a blocking cover 500 mounted on the base 100 to reciprocate to selectively expose the transfer module 300 and the workpiece 200 on provided the transfer module 300 to the outside.

As shown in FIGS. 1 and 2, the transfer module 300 is mounted on the base 100 to move the workpiece 200 back and forth (in an X direction in the FIGS. 1 and 2). A transfer belt, a transfer roller, or a linear moving roller is applicable to the transfer module 300. Meanwhile, the transfer module 300 does not transfer the workpiece 200 back and forth, but transfer the workpiece 200 left and right (in a Y direction in FIGS. 1 and 2) in a specific region, in detail, in a region in which the deburring module 400 to be described is installed. In order to change the transfer position of the workpiece 200 left and right as described above, cylinders and rack gears may be required.

Meanwhile, if the workpiece 200 can be transferred back and forth, but transferred left and right by the transfer module 300 as described above, a deburring work for lateral side portions of the workpiece 200 can be readily performed, and the details thereof will be described below.

As shown in FIGS. 1 to 3, the deburring module 400 is mounted on the transfer path of the workpiece 200 on the base 100 to substantially perform a deburring work for the workpiece 200. The deburring module 400 includes a module wall 410, which defines an internal space, has an entrance for the introduction of the workpiece 200 and an exit for the discharge of the workpiece 200, and serves as a first soundproof wall, a deburring unit 430, which includes a revolution shaft 431 installed in the internal space of the module wall 410 and rotatable by a first driving unit (not shown) and a plurality of first deburring wheels 432 spaced apart from each other around the revolution shaft 431 and rotatable by a second driving unit (not shown), and second soundproof walls 440 interposed between the module wall 410 and the deburring unit 430.

The module wall 410 forms the outer portion of the deburring module 400. The module wall 410 is provided at one side thereof with an entrance into which the workpiece 200 moving along the transfer module 300 is introduced, and provided at an opposite side thereof with an exit to discharge the workpiece 200 subject to the deburring work to the outside for a post treatment process. A door may be installed at one side of the module wall 410 to allow the worker to enter the internal space of the module wall 410. In addition, a control panel may be installed at one side of the module wall 410 to allow the worker to control the operation of the deburring unit 430 at the outside.

Meanwhile, as shown in FIG. 2, the module wall 410 serves as a first soundproof wall to minimize the noise produced in the deburring work using the deburring unit 430, that is, to minimize the transfer of the noise produced from the internal space of the module wall 410 to the outside. In this case, the module wall 410 preferably includes acoustic absorbent or a sound absorption structure so that the transfer of the working noise to the surrounding working places can be more minimized.

In addition, as shown in FIG. 1, the module wall 410 is additionally provided at an upper portion thereof with a plurality of ducts 411 to absorb foreign matters (dust, or removed burrs) produced in the deburring work for the workpiece 200 and discharge the foreign matters to the outside. In detail, each duct 411 includes a blower (not shown). After the foreign matters are sucked by the blower through the suction pressure thereof and transferred along the duct 411, the foreign matters are discharged to the outside. According to the present embodiment, in the state that the workpiece 200 is provided in the internal space of the module wall 410, the blower may be operated to discharge the foreign matters to the outside together with the deburring work. In addition, after the deburring work has been finished, the foreign matters may be discharged.

In other words, according to the present embodiment, the foreign matters may be removed simultaneously with the deburring work or after a predetermined time elapses from the deburring work. Accordingly, actually, the internal space of the module wall 410 in which the deburring work is performed becomes cleaned, so that the deburring work can be continuously performed. Therefore, work efficiency can be improved. In addition, a cleaning work by a worker is omitted, so that the cost for the deburring work can be reduced.

As shown in FIGS. 2 to 5, the deburring unit 430 includes the revolution shaft 431 rotatable by the first driving unit (not shown) and the first deburring wheels 432 which is spaced apart from each other around the revolution shaft 431 and rotatable by the second driving unit (not shown). In other words, the deburring unit 430 rotates the first deburring wheel 432 to generate the friction between the first deburring wheels 432 and the workpiece 200, thereby removing the burrs from the upper surface part of the workpiece 200. In this case, the first and second driving units (not shown) preferably include a servo-motor that can readily control the reversible rotation.

Meanwhile, as shown in FIGS. 3 and 4, the deburring unit 430 further includes an additional shaft 433 to remove burrs in a dead region or the lateral side portion of the workpiece 200 that is not readily deburred by the first deburring wheels 432.

In this case, similarly, the additional shaft 433 includes a second deburring wheel 434 and a motor to rotate the second deburring wheel 434.

Hereinafter, the deburring unit 430 will be described in more detail.

As shown in FIGS. 3 and 4, the deburring unit 430 includes one rotation shaft, that is, one revolution shaft 431 and a plurality of rotation shafts 436 having the first deburring wheels 432 mounted thereon. Accordingly, the deburring unit 430 is moved up, down, back, forth, left, and right at the upper portion of the workpiece 200 to remove burrs. The deburring unit 430 is controlled by an additional controller to be moved up, down, back, forth, left, and right. In this case, the revolution shaft 431 is a central portion about which the rotation shafts 436 are coupled with each other. The revolution shaft 431 is controlled to move up, down, back, forth, left, and right, so that the first deburring wheels 432 including the rotation shafts 436 make contact with the upper portion of the workpiece 200 to remove the burrs.

According to the present embodiment, the movement and the rotation of the revolution shaft 431 are controlled, so that the first deburring wheels 432 performs a deburring work for the upper surface of the workpiece 200. As described above, the revolution shaft 431 can be rotated clockwise or counterclockwise through the driving of the first driving unit to complement a deburring work of the rotation shaft 436 and the first deburring wheel 432.

Meanwhile, the first and second deburring wheels 432 and 434 include wool having predetermined flexibility to uniformly perform deburring works for various produces having a 3-D shape.

According to the present embodiment, the rotational directions of the rotation shafts 436 may be differently set. The rotation shafts 436 adjacent to each other preferably have rotational directions opposite to each other so that the workpiece 200 is uniformly deburred.

As shown in FIGS. 3 and 4, the additional shaft 433 is equipped with the second deburring wheel 434 so that the lateral side portion of the workpiece 200 can be deburred. If necessary, a plurality of additional shafts 433 may be installed. In addition, although the deburring work is performed by the first deburring wheel 432 including wool to deburr the lateral side portion of the workpiece 200 in some degree, the additional shaft 433 and the second deburring wheel 434 are required to more clearly debur not only the lateral side portion of the workpiece 200, but also the dead region of the workpiece 200.

According to the present embodiment, the additional shaft 433 moves up and down while rotating at a predetermined angle. In addition, the additional shaft 433 may move the second deburring wheel 434 in a transverse direction similarly to a first type of a brush of FIG. 3, or may move the second deburring wheel 434 in a longitudinal direction similarly to a second type of a brush of FIG. 3. In other words, the second deburring wheel 434 is coupled with a rotation shaft of the additional shaft 433 to rotate. At least one second deburring wheel 434 may be provided. Such a rotation shaft rotates along the circumference of the additional shaft 433 as the additional shaft 433 rotates. The rotational directions of the revolution shaft and the rotation shaft may be controlled clockwise or counterclockwise.

According to the present embodiment, the workpiece 200 is deburred through the rotation of the first deburring wheels 432 in the state that the workpiece 200 is provided in the module wall 410. In this case, the additional shaft 433 and the second deburring wheels 434 mounted on the additional shaft 433 closely make contact with the lateral side portion of the workpiece 200, so that the deburring work may not be smoothly performed according to the size or the shape of the workpiece 200. In this case, the transfer module 300 is driven left or right by the controller (shown) to space the lateral side portion of the workpiece 200 from the additional shaft 433 by a predetermined distance, so that the deburring work can be easily performed at the lateral side portion of the workpeice 200.

Next, as shown in FIG. 2, the second soundproof walls 440 are interposed between the module wall 410 and the deburring unit 430. The second soundproof walls 440 include acoustic absorbent to more reduce noise caused by the deburring work similarly to the module wall 410. In other words, according to the present invention, the module wall 410 and the second soundproof walls 440 construct a dual wall structure, thereby minimizing the transfer of noise into the surrounding working place.

The second soundproof walls 440 are mounted at the left and right sides of the transfer module 300 (in the Y direction of FIG. 2) in the internal space of the module wall 410, and have arc-shape surfaces 441 corresponding to the rotation radius of the first deburring wheels 432. Accordingly, the second soundproof walls 440 allow the smooth rotation of the first deburring wheels 432 without limitation, and absorb noise caused by the deburring work, thereby preventing the noise from being spread to the surrounding space.

In addition, since each second soundproof wall 440 has the arc-shape surface 441 with a predetermined curvature, the noise caused by the deburring work reaches the arc-shape surface 441 to cause scatter-reflection, so that the noise can be gradually cancelled.

As shown in FIG. 1, according to the present embodiment, the blocking cover 500 is mounted on the base 100 to reciprocate to selectively block the transfer module 300 and the workpiece 200 on the transfer module 300 from being exposed to the outside, and to minimize the transfer of the dust and the noise spurted through the entrance and the exit of the module wall 410 to the outside.

In detail, the blocking cover 500 covers the front and rear regions of the deburring module 400, in other words, and covers the region of the deburring module 400 before the deburring work and the region of the deburring module 400 after the deburring work. The blocking cover 500 may be covered or opened according to the selection of the worker. Further, the blocking cover 500 is preferably operated to cover the transfer module 300 when the workpiece 200 moves along the transfer module 300, or is subject to the deburring work by the deburring module 400. When the transfer module 300 is repaired or is not subject to the deburring work, the blocking cover 500 is transferred to one side of the deburring module 400, so that the blocking cover 500 preferably opens the transfer module 300 to the outside.

In the deburring work by the deburring unit 430, the burrs removed from the workpiece 200 strike to the arc-shape surface 441 of the second soundproof wall 440 due to the centrifugal force derived from the rotation of the first deburring wheels 432. Thereafter, the burrs can be discharged to the outside of the module wall 410 through the entrance and the exit of the module wall 410 according to the shape of the rounded arc-shape surface 441.

According to the present embodiment, in order to solve the problem in which the safety accident of a worker occurs due to the burrs sprung out to the surrounding working place in the deburring work, and the surrounding working place is messy with the burrs, the blocking cover 500 covers transfer modules 300 provided at the front and rear sides of the module wall 410. Therefore, as described above, the blocking cover 500 blocks the burrs discharged from the entrance and the exit of the module wall 410 from being sprung out to the surrounding working place. In addition, the blocking cover 500 prevents the noise caused by the deburring work from being delivered to the outside.

In other words, according to the present embodiment, the second soundproof wall 440 has the arc-shape surface 441 to cancel and reduce the noise caused by the deburring work. In addition, the blocking cover 550 is connected to the module wall 410 to cover the transfer modules 300 positioned at the front and rear sides of the module wall 410, thereby preventing the burrs moved along the arc-shape surface 441 and discharged to the outside of the module wall 410 from being sprung out to the surrounding working place.

As shown in FIG. 1, a transfer unit, which allows the blocking cover 500 to reciprocate, is provided on the base 100 or provided in the blocking cover 500. The transfer unit includes at least one selected from the group consisting of a rack-gear unit, a linear guide unit, and a cylinder unit. For example, if the transfer unit includes the linear guide unit, a linear guide rail is installed on the base 100 to extend legnthwise in a forward direction of the transfer module 300, and a linear guide block is installed below the blocking cover 500 so that the linear guide block is movable along the linear guide rail. Since the other transfer units have an installation structure similar to that of the linear guide unit, the details thereof will be omitted.

Meanwhile, in order to minimize the region occupied by the blocking cover 500 when the blocking cover 500 reciprocates, the blocking cover 500 may have a structure in which a plurality of cover pieces 510 are linked with each other in such a manner that the cover pieces 510 are folded, or a corrugation layer structure. In detail, if the blocking cover 500 has the link structure as shown in FIG. 1, the blocking cover 500 has the cover pieces 510 linked with each other through the link structure. The cover pieces 510 are folded when the blocking cover 500 is opened, and the cover pieces 510 are spread through a link motion when the blocking cover 500 is closed. If the blocking cover 500 has a corrugation layer structure, although not shown in detail, the blocking cover 500 has the corrugation structure that can be easily spread or folded.

In addition, according to the present embodiment, in the state that the blocking cover 500 is moved toward the deburring module 400 to limit the expose of the transfer module 300 to the outside, the worker can preferably recognize the state of the transfer module 300 and the state of the workpiece 200 transferred through the transfer module 300 by using the naked eyes of the worker.

To this end, the block cover 500 may include a transparent material or a semi-transparent material, so that the worker can be more easily recognize the state of the transfer module 300 and the state of the workpiece 200, which is transferred through the transfer module 300, through the naked eyes. In other words, although the block cover 500 includes opaque material over all, the block cover 500 may further include a transparent window, or a semi-transparent window.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A deburring apparatus comprising
   - a transfer module installed on a base to form a transfer path of transferring a workpiece to be deburred;
   - a deburring module provided on the transfer path of the workpiece installed on the base to deburr the workpiece; and
   - a blocking cover installed on the base to reciprocate thereon through a transfer unit to selectively prevent the transfer module and the workpiece on the transfer module from being exposed to an outside, and to prevent dust and noise, which are produced when a deburring work is performed for the workpiece by using the deburring module, from being delivered to the outside, wherein the deburring module comprises:
   - a module wall defining an internal space, having an entrance to introduce the workpiece and an exit to discharge the workpiece, and serving as a first soundproof wall;
   - a deburring unit installed in the internal space of the module wall and including a rotational shaft rotatable by a first driving unit;
   - a plurality of deburring wheels installed around the rotational shaft while being spaced apart from each other and rotatable by a second driving unit;
   - an additional shaft rotationally provided near a lateral side portion of the workpiece; and
   - a second deburring wheel coupled to the additional shaft to deburr the lateral side portion of the workpiece.

2. The deburring apparatus of claim 1, wherein the blocking cover covers front and rear regions of the deburring module, and has a corrugation structure or a structure in which a plurality of cover pieces are linked with each other in such a manner that the cover pieces are folded.

3. The deburring apparatus of claim 1, wherein the transfer unit includes one selected from the group consisting of a rack-gear unit, a linear gear unit, and a cylinder unit.

4. The deburring apparatus of claim 1, wherein the blocking cover includes a transparent material or a semi-transparent material.

5. The deburring apparatus of claim 1, wherein the deburring module further comprises:
   - second soundproof walls installed between the module wall and the deburring unit.

6. The deburring apparatus of claim 5, wherein the second soundproof walls are installed at left and right sides of the transfer module, respectively, and have arc-shape surfaces corresponding to a rotation radius of the deburring unit.

7. The deburring apparatus of claim 5, wherein the module wall and the second soundproof walls include acoustic absorbent.

8. The deburring apparatus of claim 5, wherein the deburring module further comprises a plurality of ducts installed on the module wall to discharge foreign matters produced in the deburring work for the workpiece to the outside after sucking the foreign matters.

* * * * *